US011659974B2

(12) United States Patent
Ferguson et al.

(10) Patent No.: US 11,659,974 B2
(45) Date of Patent: May 30, 2023

(54) APPARATUS AND METHODS FOR CLEANING DISHES WITH AN OZONE SANITIZING CYCLE

(71) Applicant: Insinger Machine Co., Philadelphia, PA (US)

(72) Inventors: Mark A. Ferguson, Rockvale, TN (US); James S. Calhoun, Corbin, KY (US); Ari B. Cantor, Warminster, PA (US)

(73) Assignee: Insinger Machine Co., Philadelphia, PA (US)

( * ) Notice: Subject to any disclaimer, the term of this patent is extended or adjusted under 35 U.S.C. 154(b) by 0 days.

(21) Appl. No.: 17/558,666

(22) Filed: Dec. 22, 2021

(65) Prior Publication Data

US 2022/0110501 A1 Apr. 14, 2022

Related U.S. Application Data

(62) Division of application No. 16/266,996, filed on Feb. 4, 2019, now Pat. No. 11,241,137.

(51) Int. Cl.
*A47L 15/00* (2006.01)
*A47L 15/42* (2006.01)
(Continued)

(52) U.S. Cl.
CPC ..... *A47L 15/0007* (2013.01); *A47L 15/001* (2013.01); *A47L 15/0026* (2013.01);
(Continued)

(58) Field of Classification Search
CPC ..... A47L 15/0007; A47L 15/001; A47L 15/0026; A47L 15/0031; A47L 15/4225;
(Continued)

(56) References Cited

U.S. PATENT DOCUMENTS 8,905,052 B2 * 12/2014 Ulger ..... A61L 2/183 134/198
8,932,410 B2 1/2015 Ulger
(Continued)

FOREIGN PATENT DOCUMENTS

DE 3232057 A1 3/1984
EP 1701644 B1 11/2009

*Primary Examiner* — Benjamin L Osterhout
(74) *Attorney, Agent, or Firm* — Mei & Mark LLP

(57) ABSTRACT

A method for cleaning dishes in a warewasher is provided: It may include filling a sump with hot water, dispensing detergent into the sump, running a wash cycle, draining the used hot water and detergent from the sump after the wash cycle, flushing the sump, filling the sump with the aqueous ozone solution, and running a rinse cycle with the aqueous ozone solution. A warewasher is provided: It may include a timer, a wash chamber, a sump, a hot water fill solenoid configured to direct hot water into the sump, a chemical dispenser, at least one spray arm, a circulation pump, an ozone generator assembly configured to provide aqueous ozone solution to the sump, and a drain assembly. The timer may control the hot water fill solenoid, the chemical dispenser, the circulation pump, the ozone generator assembly, and the drain assembly to effectuate a cleaning sequence.

20 Claims, 3 Drawing Sheets

(51) Int. Cl.
*A47L 15/44* (2006.01)
*A47L 15/14* (2006.01)
*A47L 15/50* (2006.01)

(52) U.S. Cl.
CPC ..... *A47L 15/0031* (2013.01); *A47L 15/424* (2013.01); *A47L 15/4225* (2013.01); *A47L 15/44* (2013.01); *A47L 15/0081* (2013.01); *A47L 15/14* (2013.01); *A47L 15/50* (2013.01)

(58) Field of Classification Search
CPC ..... A47L 15/424; A47L 15/44; A47L 15/14; A47L 15/50; A47L 15/0081
See application file for complete search history.

(56) References Cited

U.S. PATENT DOCUMENTS

| | | | | |
|---|---|---|---|---|
| 11,241,137 | B1 * | 2/2022 | Ferguson | A47L 15/0026 |
| 2005/0051199 | A1 | 3/2005 | Drago | |
| 2007/0251549 | A1 * | 11/2007 | Heiligenmann | A47L 15/424 134/201 |
| 2008/0190463 | A1 * | 8/2008 | Berner | A47L 15/424 134/72 |
| 2009/0032409 | A1 * | 2/2009 | Horn | A47L 15/4238 205/687 |
| 2013/0174871 | A1 * | 7/2013 | Thiyagarajan | A47L 15/4276 134/18 |
| 2013/0192642 | A1 * | 8/2013 | Beshears, Jr. | A47L 15/4219 134/104.1 |
| 2014/0000665 | A1 | 1/2014 | Graven | |

* cited by examiner

APPARATUS AND METHODS FOR CLEANING DISHES WITH AN OZONE SANITIZING CYCLE

CROSS-REFERENCE TO RELATED APPLICATION

This application is a Divisional of U.S. patent application Ser. No. 16/266,996, filed on Feb. 4, 2019, the disclosure of which is incorporated by reference in its entirety.

TECHNICAL FIELD

The present disclosure is directed to the technical field of dishwashing. More particularly, the present disclosure is directed to the technical field of dishwasher systems and methods that provide a wash cycle and sanitizer-based rinse cycle.

BACKGROUND

Conventional low-temperature dump and fill dishwashers—known in the art as "warewashers"—are used in commercial applications, for example, in restaurant kitchens. Warewashers typically run a washing cycle with detergent and then a rinsing cycle to quickly and effectively clean soiled ware. Typically, the water temperature for both the washing and rinsing cycles is between 120 F and 150 F. Further, existing warewashers incorporate a timing sequence that allows used rinse water to be reused in the subsequent wash cycle in an effort to save water.

During the rinse cycle, sanitizers—such as, chlorine, iodine, and/or quaternary ammonium compounds ("qaut")—are often used to sanitize the washed dishes. There are, however, known disadvantages to using these traditional sanitizers. These disadvantages include, for example, cost, smell, and potential safety hazards associated with these conventional sanitizer chemicals (e.g., for chlorine), as well as the requisite resources and logistics involved in their transportation and storage.

As disclosed in, for example, U.S. Pat. No. 8,932,410, titled "Dishwasher Using Ozone Water," ozone may also be used for cleaning dishes. However, at temperatures that are considered most effective for washing with detergent, the sanitizing effectiveness of aqueous ozone is substantially diminished. This is because, at higher temperatures, such as those above 100 F, a considerably smaller portion of ozone remains dissolved in water. Furthermore, the sanitizing effectiveness of aqueous ozone is generally reduced by the presence detergent. Perhaps as a result of the failure of prior art warewashers to overcome these drawbacks, ozone is not yet an approved sanitizer by the National Sanitization Foundation (NSF), as indicated in its most current standard for commercial warewashing equipment (NSF/ANSI 3-2017).

SUMMARY OF THE DISCLOSURE

The present disclosure provides a description of warewasher systems and components thereof, as well as cleaning methods, to address the perceived problems described above and others. More particularly, the present disclosure provides a description of cleaning sequences comprising an ozone-based sanitizing cycle and dish cleaning devices designed to practice the same.

In one embodiment, a method for cleaning dishes in a rack within a wash chamber of a warewasher is provided. The method may include filling a sump at the base of the wash chamber with hot water, dispensing detergent into the sump, running a wash cycle with the hot water and the detergent, draining the used hot water and detergent from the sump after the wash cycle, flushing the sump, filling the sump with the aqueous ozone solution, and running a rinse cycle with the aqueous ozone solution.

The method may further include a step of draining the used aqueous ozone solution from the sump after rinse cycle.

The method may further include a step of generating the aqueous ozone solution. The step of generating the aqueous ozone solution further may further include directing water below 100 F to an oxygen generator and generating ozone via electrolysis on the water below 100 F. The step of generating the aqueous ozone solution may include generating ozone via electrolysis to provide the aqueous ozone solution with 0.3-3 ppm ozone or with 0.5-2 ppm ozone. The step of generating the aqueous ozone solution may last between 30 and 60 seconds.

The steps of (i) generating the aqueous ozone solution and (ii) running the wash cycle with the hot water and the detergent may occur at least partially simultaneously. The steps of (i) flushing the drained sump and (ii) draining the used hot water and detergent from the sump may occur at least partially simultaneously.

The step of running the rinse cycle with the aqueous ozone solution may last between 15 and 25 seconds. The step of flushing the sump may include flushing the sump with aqueous ozone solution and may last between 1 and 3 seconds.

In another embodiment, a warewasher is provided. The warewasher may include a timer, a wash chamber with a rack support to receive a rack with dishes, a sump disposed at the base of the wash chamber, a hot water fill solenoid configured to be attached to a hot water supply and to direct hot water into the sump, a chemical dispenser, at least one spray arm, a circulation pump configured to pump liquid from the sump through the at least one spray arm, an ozone generator assembly configured to provide aqueous ozone solution to the sump, and a drain assembly at the base of the sump. The timer may be configured to control the hot water fill solenoid, the chemical dispenser, the circulation pump, the ozone generator assembly, and the drain assembly to effectuate a cleaning sequence.

The ozone generator assembly may include an ozone generator solenoid, an ozone generator, and an ozone generator drain valve at the base of the ozone generator. The ozone generator solenoid may be configured to be attached to a cold water supply. The ozone generator may be configured to receive cold water from the ozone generator solenoid. The ozone generator drain valve may be configured to dispense aqueous ozone solution into the sump. The timer may be configured to control provision of the aqueous ozone solution to the sump by controlling the ozone generator solenoid, the ozone generator, and the ozone generator drain valve.

The ozone generator assembly may be configured to generate the aqueous ozone solution with 0.3-3 ppm ozone in 30-60 seconds.

The drain assembly may include a drain shoot and a plunger. The timer may be further configured to control drainage of the sump by controlling the plunger.

The cleaning sequence may include filling the sump with hot water, dispensing detergent into the sump, running a wash cycle with the hot water and the detergent, draining the used hot water and detergent from the sump after the wash cycle, flushing the sump, filling the sump with the aqueous ozone solution, and running a rinse cycle with the aqueous ozone solution.

The cleaning sequence may further include draining the used aqueous ozone solution from the sump after rinse cycle.

The timer may be configured to run the rinse cycle with a duration of between 15 and 25 seconds. The timer may be configured to flush the sump for a duration of between 1 and 3 seconds.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosure.

DETAILED DESCRIPTION

Figure 1:
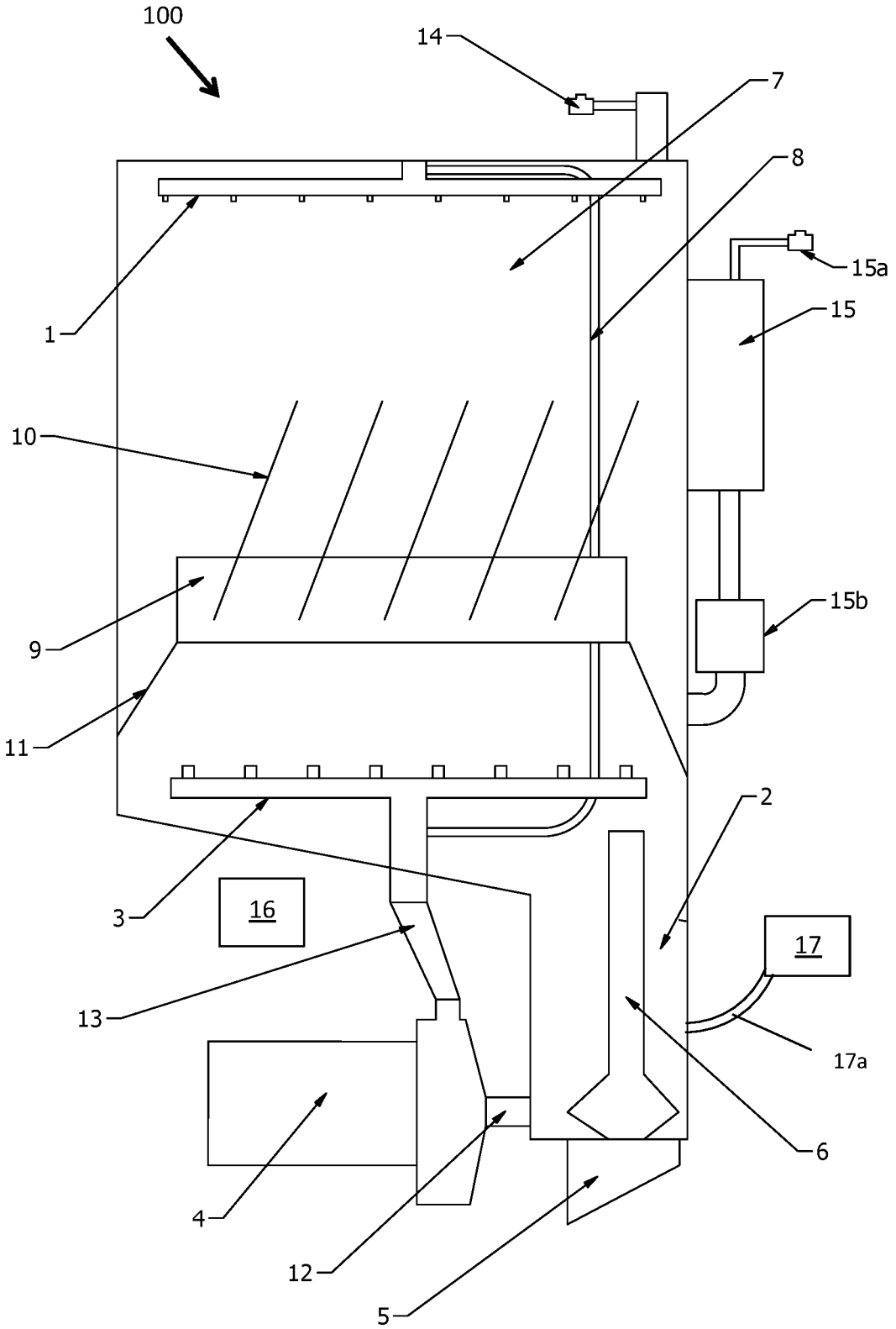
FIG. 1 is a block diagram of a warewasher, according to an exemplary embodiment of the present disclosure.
Figure 2:
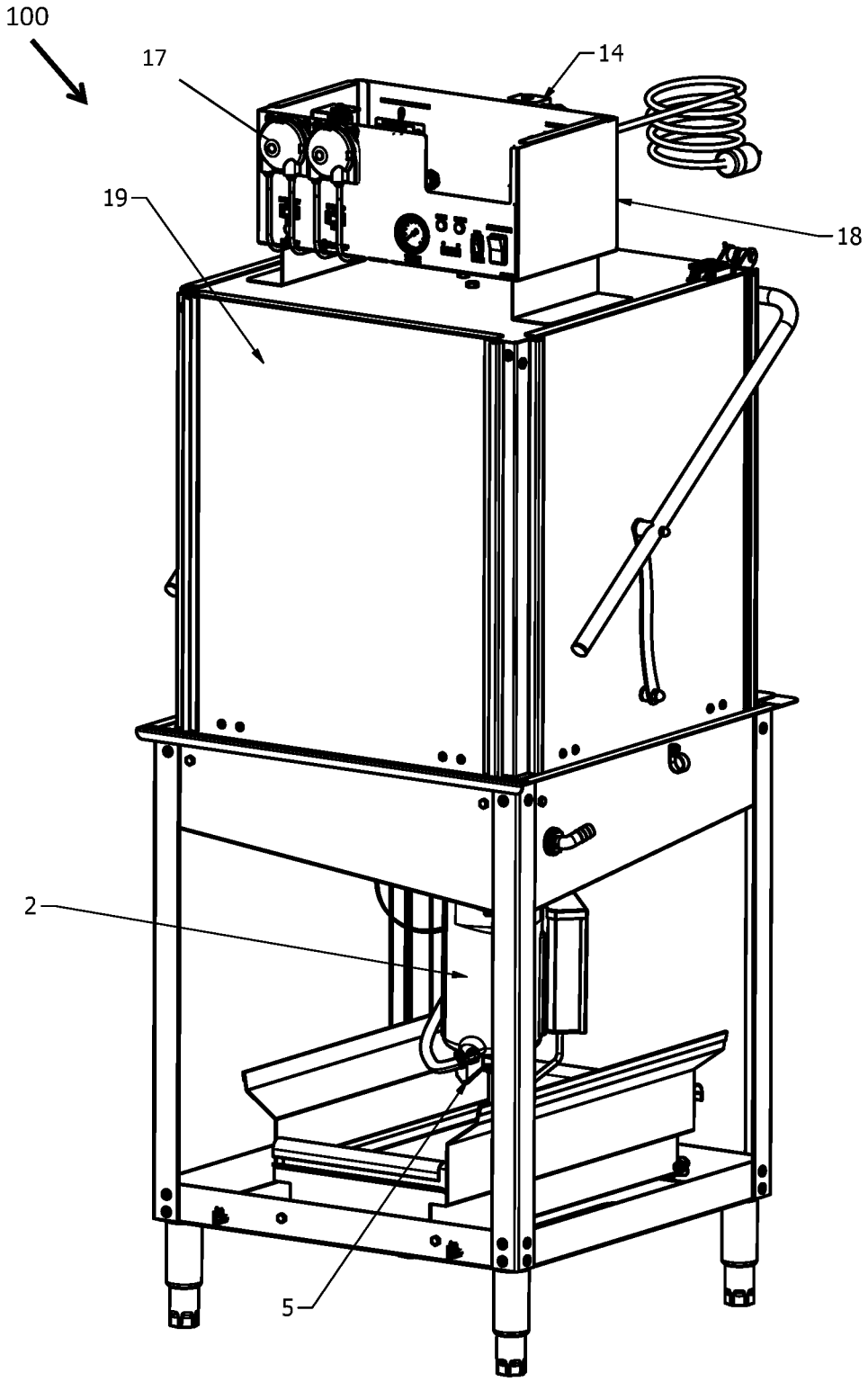
FIG. 2 is a diagram illustrating the exterior of a warewasher, according to an exemplary embodiment of the present disclosure.

With reference to FIGS. 1 and 2, warewasher 100 may include upper spray arm 1; sump 2; lower spray arm 3; circulation pump 4; a drain assembly 5, 6; wash chamber 7; water transmission lines 8, 12, 13; rack support 11; hot water fill solenoid 14; an ozone generator assembly 15, 15*a*, 15*b*; timer 16; chemical dispenser 17; control box 18; and enclosure 19. Many of the above-listed components of warewasher 100 may be common to conventional warewashers and, consistent with the understanding of a person of ordinary skill in the art, may be substituted for other components or configurations known to accomplish the same or similar functions.

Dishes 10 and rack 9 are depicted in FIG. 1 for illustrative purposes, but are generally not considered to be a part of warewasher 100. Warewasher 100 may accommodate one or more racks 9 supported by rack support 11 to hold dishes 10 within wash chamber 7. Upper spray arm 1 and/or lower spray arm 3 may be positioned within wash chamber 7, and may be utilized to spray water on dishes 10 during various cleaning cycles.

Sump 2 may be disposed at the base of wash chamber 7 above a drain assembly. The drain assembly may include drain shoot 5 and plunger 6 (or another known mechanism controlling drain flow). Drain shoot 5 may be positioned at the base of sump 2, allowing sump 2 to be fully drained. Plunger 6 may be positioned upon the drain shoot 5, and may thereby permit liquid within sump 2 to drain only when it is lifted. Plunger 6 may preferably include a rubber ball stopper affixed to its base to fully seal drain shoot 5 closed when in a lowered position. Preferably, plunger 6 may be actuated through a pull-type solenoid.

Circulation pump 4 may be configured to draw in water, including detergent solutions and aqueous ozone solutions, through water transmission line 12 and may supply water to lower spray arm 3 via water transmission line 13 and to upper spray arm 1 through water transmission line 8 (or water transmission lines 8 and 13 in some embodiments).

Hot water may be introduced into sump 2 and/or wash chamber 7 through hot water fill solenoid 14, which is configured to be attached to a hot water supply, such as a hot water tap.

Sanitizing rinse water containing aqueous ozone may be introduced into sump 2 and/or wash chamber 7 through the ozone generator assembly. In preferred embodiments, the ozone generator assembly may include ozone generator 15, ozone generator solenoid 15*a*, and ozone generator drain valve 15*b*. Cold water from a cold water supply, such as cold water tap may be introduced into ozone generator 15 via ozone generator solenoid 15*a*.

Ozone generator 15 may generate ozone in the water through electrolysis, which generates tiny ozone bubbles that dissolve in the water. It has been determined that at least 0.3 ppm ozone within an aqueous ozone solution may be needed for sterilization. In certain preferred embodiments, warewasher 100 may provide aqueous ozone solution at 0.8-1.2 ppm ozone. This may be expected to compensate for ozone that may come out of solution during the filling of sump 2 and agitation under the power of circulation pump. In other embodiments, aqueous ozone solution at 0.3-3 ppm ozone may be provided. It has been observed the suitably priced and sized ozone generators can currently produce up to 3 ppm ozone in one gallon of cold water within 45 seconds. However, in yet other embodiments, aqueous ozone solution at 0.5-2 ppm ozone may be provided. Such range may ensure that sufficient sanitation power is provided, while reducing potential side effects of ozone exposure to certain types of dishes, such as those coated with Teflon.

Additionally, it may be noted that ozone-based sterilization is most effective at or around 70 F and has substantially reduced effectiveness above 100 F. The above-recited ranges of ppm ozone all compare favorably with chlorine-based sanitization, which requires at least 10 seconds at 50 ppm to effectively sterilize. As is known in the art, effective sterilization may be characterized by a 5 Log reduction in *E. coli* populations on inoculated dishes. It was been observed that, even at the substantially lower concentrations of ozone recited in the above paragraph, aqueous ozone solution sanitizes 10 times faster than chlorine solution.

Ozone generator drain valve 15*b* may be a controllable valve, such as an electrically actuated ball valve. When ozone generator drain valve 15*b* is actuated, it may permit aqueous ozone solution within ozone generator 15 to flow into sump 2 and/or wash chamber 7.

Chemical dispenser 17 may, for example, be a dosing pump configured to supply a chemical to sump 2 and/or wash chamber 7 via chemical conduit 17*a*. In preferred embodiments, a chemical bottle may connect to chemical dispenser 17 via polyethylene tubes and chemical dispenser 17 may comprise a peristaltic pump. Detergent may be provided through chemical dispenser 17. In preferred embodiments, chemical dispenser 17 may be located on enclosure 19 containing the bulk of warewasher 100 elements, attached to control box 18, or otherwise separated from enclosure 19. In some embodiments, for example as depicted in FIG. 2, warewasher 100 may include multiple chemical dispensers 17. Additional chemical dispensers 17 may be utilized to dispense, for example, Rinse Aid or a liquid-based sanitizer.

Timer 16 may be positioned within control box 18, which may be located within or upon enclosure 19.

Timer 16 may preferably comprise a digital controller. It may control the operation of warewasher 100 via controlling hot water fill solenoid 14, ozone generator solenoid 15*a*, circulation pump 4, ozone generator 15, ozone generator drain valve 15*b*, chemical dispenser(s) 17, and plunger 6. The digital controller of timer 16 may further include a central processing unit (CPU) or other processor or set of processors suitable for performing the functions disclosed herein as would be apparent to persons having skill in the relevant art. The digital controller may receive data associated with input by an operator. It may also be configured to read data and software stored in associated non-volatile storage and memory; write data and software stored in non-volatile storage and memory; and execute program code stored in the memory or non-volatile storage. The digital controller may be further configured to execute embodiments of the methods disclosed herein. Additional functions performed by digital controller will be apparent to persons having skill in the relevant art and may also be discussed herein. The memory may store data suitable for performing the functions disclosed herein. Some or all of the data and software stored within non-volatile storage may be copied to memory to support the processing functions of digital controller.

Figure 3:
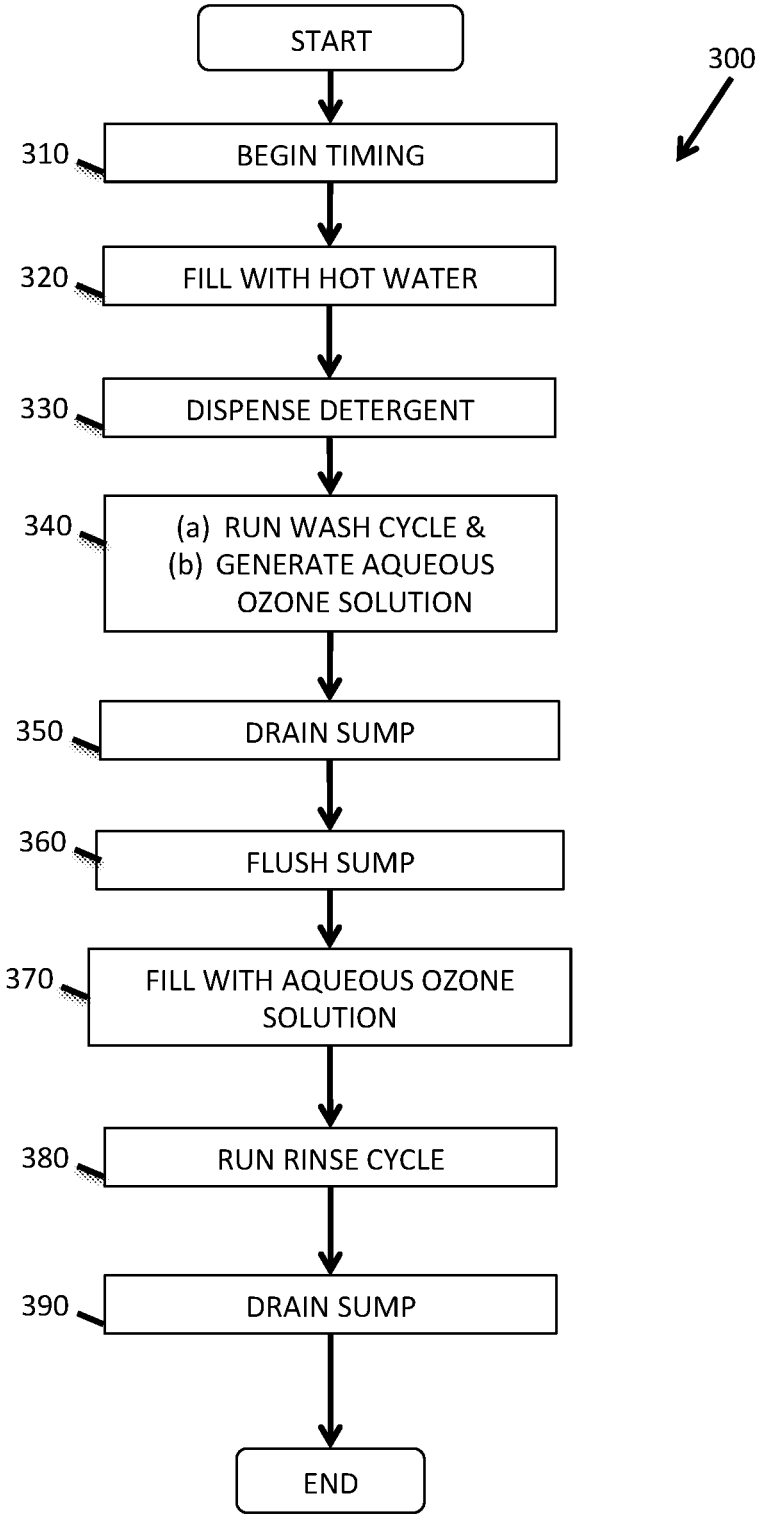
FIG. 3 is a flow chart of a method of dishwashing with a sanitizing ozone cycle, according to an exemplary embodiment of the present disclosure.

With reference to FIG. 3, method 300 may accomplish cleaning dishes by, in part, using aqueous ozone solution to sterilize dishes during a rinse cycle. Additionally, the cleaning sequence of method 300 may ensure that wash water is fully drained and flushed before starting the sanitizing rinse cycle. Warewasher 100 may perform method 300. Timer 16 may provide the timing for and govern the cleaning sequence by controlling electromechanical components of warewasher 100 at pre-programmed intervals.

Prior to beginning method 300, soiled dishes 10 may be loaded into one or more racks 9 and placed in wash chamber 7. In some circumstances, dishes 10 may be pre-washed prior to being loaded. In certain embodiments, dishes 10 may be pre-washed by warewasher 100 to dislodge food particles that may be stuck on the dishes.

As in step 310, the cleaning sequence may begin. In preferred embodiments, timer 16 begins the cleaning sequence—and timer 16's timing thereof—automatically upon closure upon the door of the warewasher 100. In alternative embodiments, the cleaning sequence may be triggered by an operator's button press or the like. The method may proceed to step 320 and/or 330.

As in step 320, sump 2 is filled with hot water for the wash cycle. Specifically, timer 16 may cause hot water fill solenoid 14 to open, allowing for a predetermined amount of hot water to flow into sump 2. Preferably, the temperature of the hot water is around 140 F. It is contemplated that hot tap water may be used.

As in step 330, detergent may be dispensed. Detergent may be dispensed into sump 2 via chemical dispenser 17 under the control of timer 16.

In preferred embodiments steps 320 and 330 may occur simultaneously or otherwise overlap. The introduction of both detergent and hot water into the sump at the same time may improve mixing these components for the wash cycle. However, in alternative embodiments, step 320 may follow step 330 or vice versa. After steps 320 and 330, the process may proceed to step 340.

As in step 340*a*, the wash cycle may be run. Timer 16 may direct circulation pump 4 to run, which further mixes the detergent and water and exposes dishes 10 to high-pressure spray from spray arms 1,3, thereby washing dishes 10. It may be noted that the wash cycle may be understood to proceed in typical, known manner among conventional warewashers. For example, it may last approximately 45 seconds. Once timer 16 indicates the end of the wash cycle, circulation pump 4 may cease to run.

As in step 340*b*, aqueous ozone solution may be generated. The process for generating aqueous ozone solution may begin when timer 16 actuates ozone generator solenoid 15*a*, thereby allowing cold water from the cold water supply, such as a cold water tap, to flow into ozone generator 15. Once ozone generator 15 begins to fill (or is fully or partially filled), timer 16 may direct ozone generator to begin electrolysis or otherwise begin producing the aqueous ozone solution; it may also direct ozone generator solenoid 15*a* to close once ozone generator 15 is filled. In preferred embodiments, ozone generator 15 may run for approximately 45 seconds per cleaning sequence. In alternative embodiments, ozone generator 15 may run between 30 and 60 seconds. Once the aqueous ozone solution has been generated, timer 16 may direct ozone generator 15 to stop running.

In preferred embodiments, step 340*a* and 340*b* may proceed simultaneously to promote time efficiency of the cleaning sequence. In other embodiments, the step of generating aqueous ozone solution may occur before, after, or partially overlap with the wash cycle. However, in such circumstances, it is preferred that step 340*b* may complete prior to step 360.

As in step 350, sump 2 may be drained to remove the hot detergent-laden waste water from the wash cycle. Plunger 6 may be raised under the control of timer 16 to allow the waste water to enter drain shoot 5.

As in step 360, sump 2 may be flushed. After at least most of the waste water has been drained, clean water may be provided to the system to allow sump 2 to be flushed of residual detergent. In preferred embodiments, the clean water comprises aqueous ozone solution and is provided for between 1-3 seconds to accomplish flushing. Such aqueous ozone solution may begin to flow when timer 16 actuates ozone generator drain valve 15*b* to allow it to flow into sump 2. In some embodiments, the flow of aqueous ozone solution through ozone generator drain valve 15*b* may begin during, but towards the end of, draining step 350 to reduce the overall timing cycle. In preferred embodiments, dishes 10 and the main interior wash chamber 7 may not be flushed as the main concentration of waste water and residual detergent may be expected to remain in small pool of water left in the bottom of the sump 2 after step 350.

Concluding step 360, plunger 6 may be lowered under the control of timer 16 to close drain shoot 5. Then the process may proceed to step 370.

As in step 370, sump 2 may be filled with aqueous ozone solution. Preferably, the flow of aqueous ozone solution from ozone generator 15 may continue from step 360; because drainage has ceased, the aqueous ozone solution may collect in sump 2. In other embodiments, a new flow of aqueous ozone solution from ozone generator 15 may begin in step 370. To terminate step 370, timer 16 may cause ozone generator drain valve 15*b* to stop the flow of aqueous ozone solution. Once sump 2 is filled with aqueous ozone solution, the process may proceed to step 380.

As in step 380, the rinse cycle may be run. Timer 16 may direct circulation pump 4 to run, which causes dishes 10 to receive high-pressure spray from spray arms 1,3, thereby rinsing remaining residues off dishes 10 and sanitizing them with circulating aqueous ozone solution.

In preferred embodiments, the rinse cycle may run between 10-25 seconds. Chlorine-based sanitizing rinse cycles known in the art typically run for approximately 25 seconds. While, as noted above, ozone may sanitize at a rate 10 times faster, a rinse cycle at around 2.5 seconds may be insufficient to rinse any remaining wash cycle residues off of dishes 10—even as it is expected to adequately sanitize. Thus, a rinse cycle of at least 10 seconds is contemplated. In preferred embodiments, the rinse cycle may run between 15-25 seconds to ensure adequacy, or between 10 and 20 seconds for a reduced cleaning sequence time. Once the rinse cycle is completed, the process may proceed to step 390.

As in step 390, sump 2 may be drained to remove the remaining aqueous ozone solution, and the time cycle is completed.

Once method 300 is concluded, the operator may open the door to remove rack 9 with washed and sterilized dishes 10. Then, warewasher 100 may be ready for a new load of dishes 10 and to begin the next cleaning sequence.

It is contemplated that, in alternative embodiments, step 390 may be omitted and the remaining aqueous ozone solution may be reused in the wash cycle of subsequent cleaning sequence—as is done in conventional warewashers. Although such alternate method may save water, the remaining aqueous ozone solution may be expected to be below 100 F and must be heated to at least 120 F for an effective wash cycle. This would disadvantageously increase the duration of the overall timing of the cleaning sequence and may necessitate the addition of heating elements to warewasher 100. Beyond this, maintaining step 390 is favored because of the expected cost savings of generating ozone on site and the improved environmental impact attendant to avoiding the use and transportation of chlorine or other sanitizers favor.

In certain embodiments, warewasher 100 may further include operator controls that may permit an operator to control the ozone concentration, and/or elect to have warewasher 100 operate without any ozone on some occasions. In such embodiments, timer 16 may alter the overall operating time for ozone generator 15 and/or alter the intensity of its electrolytic processes to arrive at a desired ozone concentration.

It is also contemplated that the above-disclosed principles may be applied to other dishwashing technologies. However, there are additional challenges to such applications. For example, aqueous ozone solution may be used to sterilize in a freshwater rinse system. However, for such a system to be effective, 5-10 gallons per minute (gpm) of aqueous ozone solution at a sufficient concentration would need to be produced on demand. Currently available ozone generation technology capable of such rapid production is prohibitively expensive for such a commercial dishwashing application. Future innovation in ozone generation technology may alter this calculus.

As another example, a rotary glass washer could be modified to sterilize with aqueous ozone solution because it has a wash system that is separate from the rinse system. However, unlike warewashers, which circulate rinse water via a circulation pump, rotary glass washers dump all rinse water down the drain after a single spraying. Accordingly, a rotary glass washer's rinse cycle runs at 2-5 gpm. Currently available ozone generation technology capable of such rapid production is prohibitively expensive for such a commercial dishwashing application. Again, future innovation in ozone generation technology may alter this calculus.

Although the foregoing embodiments have been described in detail by way of illustration and example for purposes of clarity of understanding, it will be readily apparent to those of ordinary skill in the art in light of the description herein that certain changes and modifications may be made thereto without departing from the spirit or scope of the appended claims. It is also to be understood that the terminology used herein is for the purpose of describing particular aspects only, and is not intended to be limiting, since the scope of the present invention will be limited only by the appended claims.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation. As will be apparent to those of ordinary skill in the art upon reading this disclosure, each of the individual aspects described and illustrated herein has discrete components and features which may be readily separated from or combined with the features of any of the other several aspects without departing from the scope or spirit of the disclosure. Any recited method can be carried out in the order of events recited or in any other order that is logically possible. Accordingly, the preceding merely provides illustrative examples. It will be appreciated that those of ordinary skill in the art will be able to devise various arrangements which, although not explicitly described or shown herein, embody the principles of the disclosure and are included within its spirit and scope.

Furthermore, all examples and conditional language recited herein are principally intended to aid the reader in understanding the principles of the invention and the concepts contributed by the inventors to furthering the art, and are to be construed without limitation to such specifically recited examples and conditions. Moreover, all statements herein reciting principles and aspects of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary configurations shown and described herein.

In this specification, various preferred embodiments have been described with reference to the accompanying drawings. It will be apparent, however, that various other modifications and changes may be made thereto and additional embodiments may be implemented without departing from the broader scope of the claims that follow. The specification and drawings are accordingly to be regarded in an illustrative rather than restrictive sense.

We claim:

1. A method for cleaning dishes in a rack within a wash chamber of a warewasher, the method comprising:

filling a sump at the base of the wash chamber with hot water;

dispensing detergent into the sump;

running a wash cycle with the hot water and the detergent;

draining the used hot water and detergent from the sump after the wash cycle;

flushing the sump;

filling the sump with an aqueous ozone solution; and running a rinse cycle with the aqueous ozone solution.

2. The method of claim 1, further comprising:

draining the used aqueous ozone solution from the sump after rinse cycle.

3. The method of claim 1, further comprising:

generating the aqueous ozone solution.

4. The method of claim 3, wherein:

the steps of (i) generating the aqueous ozone solution and (ii) running the wash cycle with the hot water and the detergent occur at least partially simultaneously.

5. The method of claim 4, wherein:

the step of running the rinse cycle further comprises pumping the aqueous ozone solution from the sump and through at least one spray arm with a circulation pump; and the step of running the wash cycle further comprises pumping the hot water and the detergent from the sump and through the at least one spray arm with the circulation pump.

6. The method of claim 3, wherein:

the step of generating the aqueous ozone solution lasts between 30 and 60 seconds.

7. The method of claim 3, wherein the step of generating the aqueous ozone solution further comprises:

directing water below 100 F to an oxygen generator; and generating ozone via electrolysis on the water below 100 F.

8. The method of claim 7, wherein the step of filling the sump with an aqueous ozone solution further comprises:

directly providing the aqueous ozone solution to the sump from an ozone generator.

9. The method of claim 3, wherein the step of generating the aqueous ozone solution further comprises:

generating ozone via electrolysis to provide the aqueous ozone solution with 0.3-3 ppm ozone.

10. The method of claim 9, wherein the step of filling the sump with an aqueous ozone solution further comprises:

directly providing the aqueous ozone solution to the sump from an ozone generator.

11. The method of claim 3, wherein the step of generating the aqueous ozone solution further comprises:

generating ozone via electrolysis to provide the aqueous ozone solution with 0.5-2 ppm ozone.

12. The method of claim 3, wherein:

the step of running the rinse cycle further comprises pumping the aqueous ozone solution from the sump and through at least one spray arm with a circulation pump; and the step of running the wash cycle further comprises pumping the hot water and the detergent from the sump and through the at least one spray arm with the circulation pump.

13. The method of claim 3, wherein the step of filling the sump with an aqueous ozone solution further comprises:

directly providing the aqueous ozone solution to the sump from an ozone generator.

14. The method of claim 1, wherein:

the step of running the rinse cycle with the aqueous ozone solution lasts between 15 and 25 seconds.

15. The method of claim 14, wherein:

the step of running the rinse cycle further comprises pumping the aqueous ozone solution from the sump and through at least one spray arm with a circulation pump; and the step of running the wash cycle further comprises pumping the hot water and the detergent from the sump and through the at least one spray arm with the circulation pump.

16. The method of claim 1, wherein:

the step of flushing the sump further comprises flushing the sump with aqueous ozone solution; and the step of flushing the sump lasts between 1 and 3 seconds.

17. The method of claim 1, wherein:

the steps of (i) flushing the drained sump and (ii) draining the used hot water and detergent from the sump occur at least partially simultaneously.

18. The method of claim 1, wherein:

the step of running the rinse cycle further comprises pumping the aqueous ozone solution from the sump and through at least one spray arm with a circulation pump; and the step of running the wash cycle further comprises pumping the hot water and the detergent from the sump and through the at least one spray arm with the circulation pump.

19. The method of claim 1, wherein the step of filling the sump with an aqueous ozone solution further comprises:

directly providing the aqueous ozone solution to the sump from an ozone generator.

20. The method of claim 1, further comprising:

attaching an ozone generator solenoid to a cold water supply, the ozone generator solenoid being configured to provide cold water to an ozone generator; and attaching a hot water fill solenoid to a hot water supply, the hot water fill solenoid being configured to direct hot water into the sump.

* * * * *